US007497650B2

(12) United States Patent
Li et al.

(10) Patent No.: US 7,497,650 B2
(45) Date of Patent: Mar. 3, 2009

(54) NEW-TYPE CORNER FITTING

(75) Inventors: Zeshen Li, Shenzhen (CN); Heqing Kong, Shenzhen (CN); Gu Yao, Shenzhen (CN)

(73) Assignee: China International Marine Containers (Group) Co., Ltd., Guangdong (CN)

( * ) Notice: Subject to any disclaimer, the term of this patent is extended or adjusted under 35 U.S.C. 154(b) by 236 days.

(21) Appl. No.: 11/219,787

(22) Filed: Sep. 7, 2005

(65) Prior Publication Data

US 2006/0056935 A1 Mar. 16, 2006

(30) Foreign Application Priority Data

Sep. 10, 2004 (CN) ..... 2004 2 0091342

(51) Int. Cl.
*B63B 25/00* (2006.01)

(52) U.S. Cl. ..... 410/52

(58) Field of Classification Search ..... 410/52
See application file for complete search history.

(56) References Cited

U.S. PATENT DOCUMENTS

| | | | | |
|---|---|---|---|---|
| 3,138,398 | A * | 6/1964 | Silverman | 294/68.1 |
| 3,262,729 | A * | 7/1966 | Willison et al. | 294/68.3 |
| 3,386,600 | A * | 6/1968 | Betjemann | 294/68.1 |
| 3,456,829 | A * | 7/1969 | Glassmeyer | 220/1.5 |
| 3,966,075 | A * | 6/1976 | Schultz | 220/1.5 |
| 6,168,031 | B1 * | 1/2001 | Schmidt | 211/46 |
| 7,063,481 | B2 * | 6/2006 | Trull | 403/170 |
| 2004/0091346 | A1 * | 5/2004 | Wobben | 414/563 |

* cited by examiner

*Primary Examiner*—H Gutman
(74) *Attorney, Agent, or Firm*—Rosenberg, Klein & Lee

(57) ABSTRACT

A new-type corner fitting for a container includes a bottom face, a top face, an inner side face, an outer side face, a front end face and a rear end face. The front end face and the inner side face are cut out in part to form a step. The overall external dimensions of said corner fitting is slightly larger than the overall external dimensions of a traditional corner fitting. The corner fitting comprises a bevel between the inner side face and the bottom face thereof. The front end face is cut out in part to form a horizontal first portion of the step, and the bevel close to the front end face is cut out to form an oblique second portion of the step.

5 Claims, 4 Drawing Sheets

NEW-TYPE CORNER FITTING

BACKGROUND OF THE INVENTION

1. Field of the Invention

The present invention relates to a container, in particular to a corner fitting which is used in a container.

2. Description of the Prior Art

In a container, corner fittings are generally used to connect with the other components of the container to build up a complete container body. FIG. 1 is a schematic structure view of a traditional corner fitting. FIG. 2 is a partial schematic view of the container body with some said corner fittings. In the traditional container structure, there are some sealing gaskets fixed around the circumference of the gate of the container body. To increase the size of the gate without changing the height and the width of the container body, it is required to reduce the thickness of the lintel to the approximate thickness of the top plate. Because there are no sealing devices at the inner side of the corner fittings, the sealing gaskets around the circumference of the gate can not lean against any flat surface. It leads to a bad sealing effect of the container body.

In Chinese Patent No. ZL02227835.4 (the name is A NEW-TYPE CORNER FITTING), a corner fitting comprises a L-shaped flange on the inner side face and on the bottom face thereof as a sealing device to solve the sealing problem of the container body (shown in FIG. 3). However, the manufactural process is too complicated and hard to ensure welding quality of the sealing devices.

SUMMARY OF THE INVENTION

The object of the present invention is to provide a new-type corner fitting whose manufactural process is simple. The container with large-size gate assembled with the corner fittings gets a better sealing effect than before.

For achieving the aforementioned object, the present invention brings forward the following technical solution:

A new-type corner fitting for a container comprises a bottom face, a top face, an inner side face, an outer side face, a front end face and a rear end face. The front end face and the inner side face are cut out in part to form a step.

The new-type corner fitting, wherein, the overall external dimensions of said corner fitting is slightly larger than the overall external dimensions of a traditional corner fitting. It ensures that the volume of the inner cavity of the corner fitting doesn't reduce after the front end face and the inner side face have been cut out to influence normal operations of the corner fitting.

The new-type corner fitting, wherein, the corner fitting comprises a bevel between the inner side face and the bottom face thereof. The front end face is cut out in part to form a horizontal first portion of the step, and the bevel close to the front end face is cut out to form an oblique second portion of the step. It results in the seal gasket leaned against the first portion of the step and the second portion of the step transiting more easily. And accumulated water in the inner cavity of the corner fitting is eliminated easily.

The new-type corner fitting, wherein, the length of the first portion of the step is equal to or shorter than the length of the front end face, and the length of the second portion of the step is equal to or shorter than the length of the inner side face. The two portions of the step connect together and transit smoothly.

The new-type corner fitting, wherein, said corner fitting is an integrated forming structure.

The new-type corner fitting, wherein, said corner fitting comprises a hole on the outer side face for eliminating the accumulated water in the inner cavity thereof. It leads to accumulated water in the inner cavity of the corner fitting be eliminated easily.

Due to adopt the aforementioned structures in the present invention, the manufactural process of said corner fitting is very simple. It is solved that sealing well at the places where the corner fittings will be fixed of the container with a large-size gate. Because the corner fitting has two portions of the step for sealing, the container with a large-size gate which is assembled with the corner fittings doesn't need to fix any auxiliary sealing structures at the places where the corner fittings will be fixed. So it becomes much simpler than that of the prior arts about the assembly processes of the container with a large-size gate to a certain extent.

DESCRIPTION OF THE PREFERRED EMBODIMENT

Figure 1:
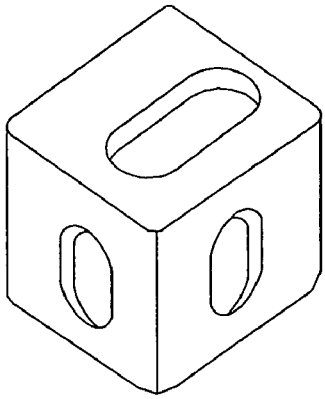
FIG. 1 is a schematic structure view of a traditional corner fitting.
Figure 2:
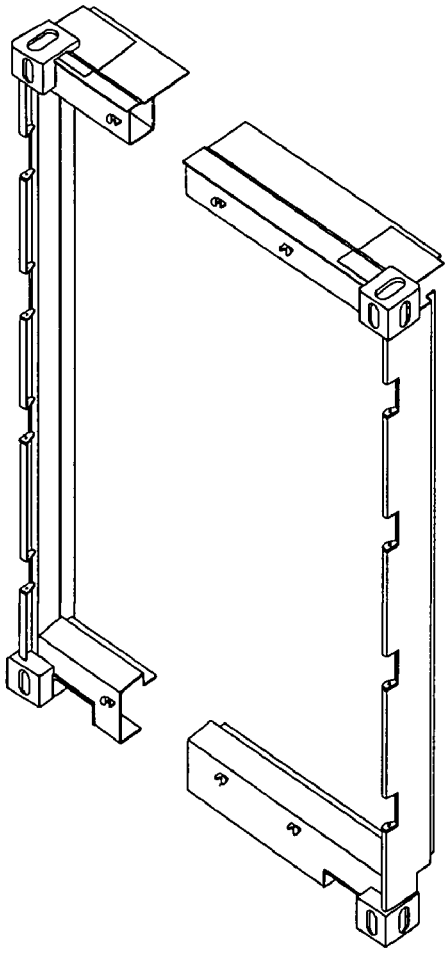
FIG. 2 is a partial schematic view of a container body connected with the conditional corner fittings.
Figure 3:
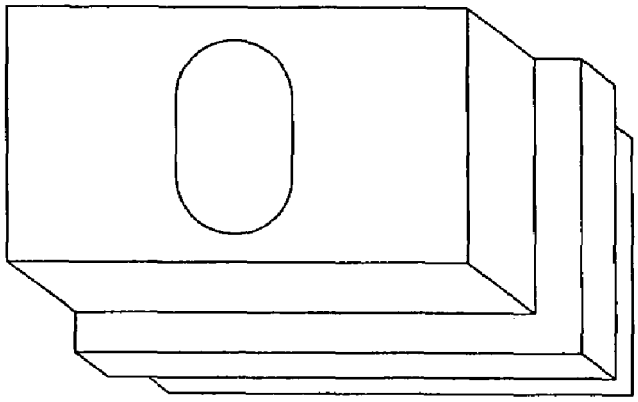
FIG. 3 is a schematic structure view of the corner fitting disclosed in the patent No. ZL02227835.4.
Figure 4:
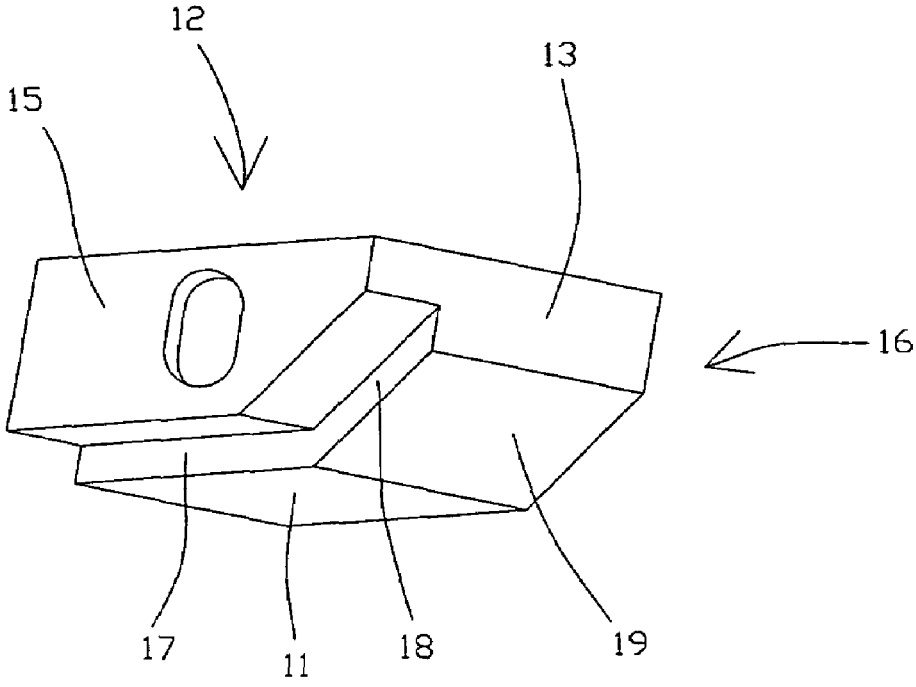
FIG. 4 and FIG. 5 are two schematic structure views of an embodiment of the corner fitting according to the present invention.
Figure 5:
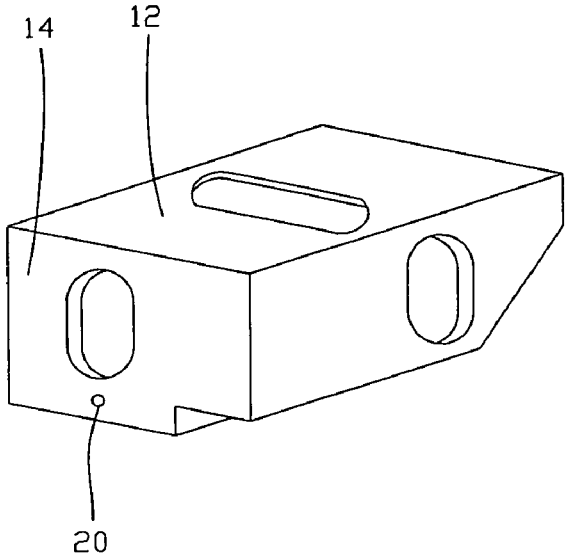
Figure 6:
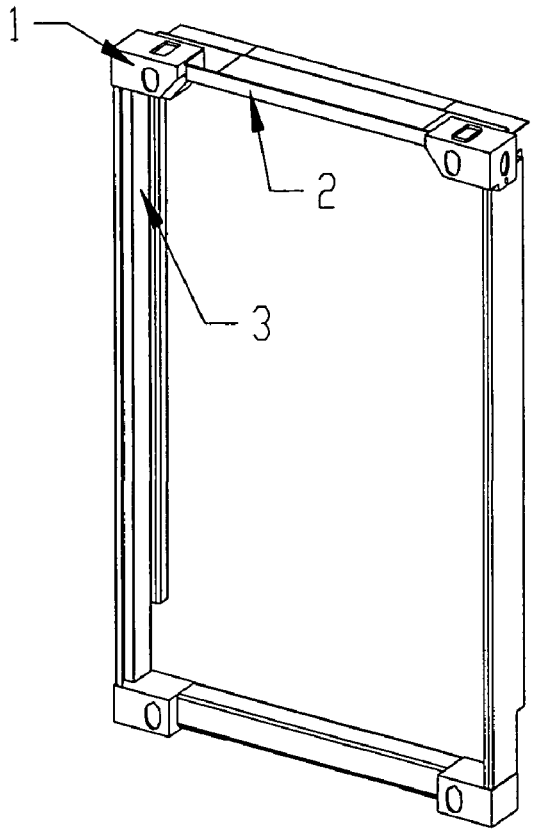
FIG. 6 is a partial schematic view of a container body connected with the corner fittings according to the present invention.
Figure 7:
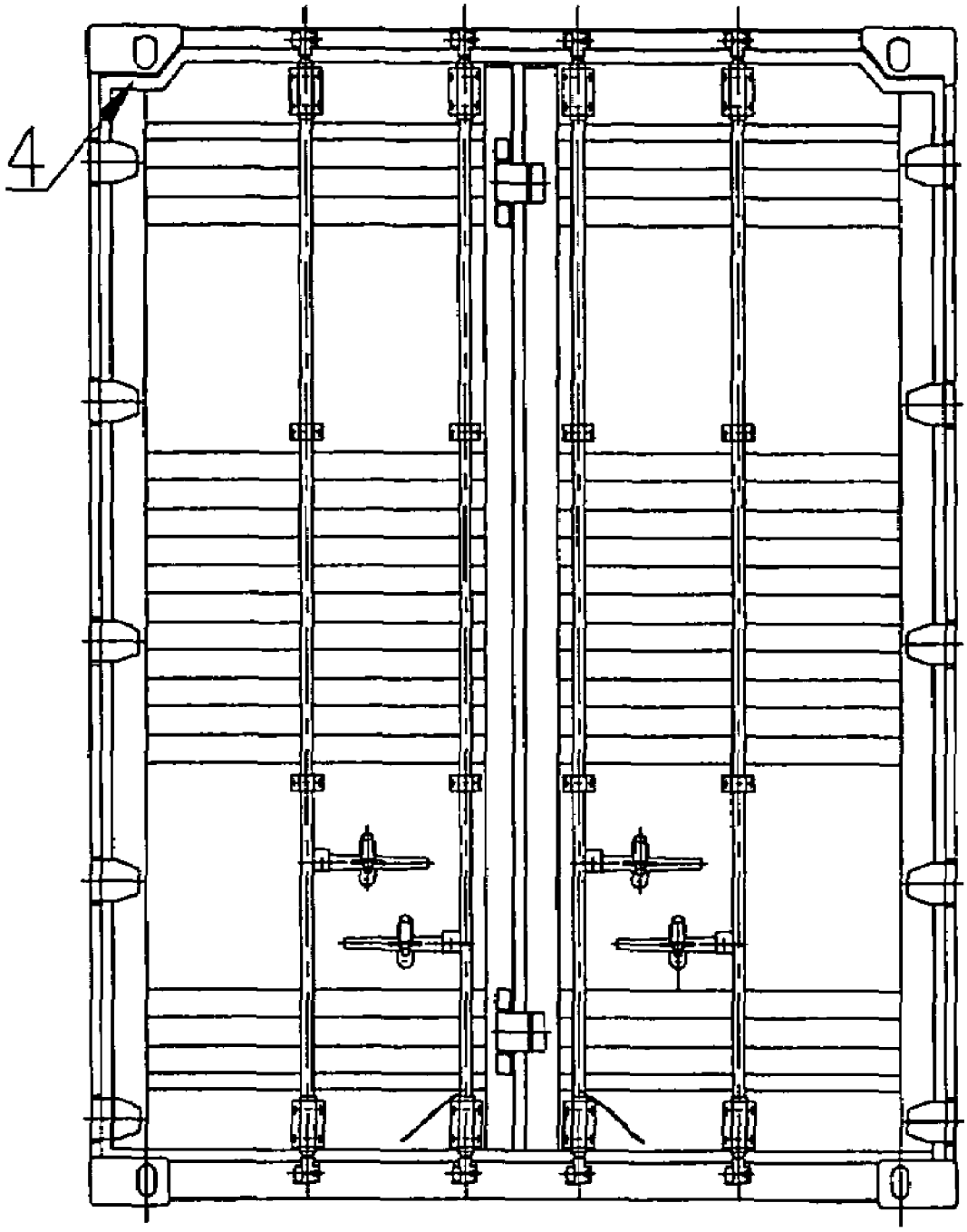
FIG. 7 is a back view of the container body connected with the corner fittings according to the present invention.

As shown in FIG. 4 and FIG. 5, according to the present invention, a corner fitting 1 comprises a bottom face 11, a top face 12, an inner side face 13, an outer side face 14, a front end face 15 and a rear end face 16. The front end face 15 and the inner side face 13 are cut out in part to form a step. The front end face 15 is cut out in part to form a horizontal first portion 17 of the step. The corner fitting 1 comprises a bevel 19 between the inner side face 13 and the bottom face 11 thereof. The bevel 19 close to the front end face 15 is cut out to form an oblique second portion 18 of the step. The horizontal portion 17 and the oblique portion 18 of the step connect together and transit smoothly. It ensures that the volume of the inner cavity of the corner fitting 1 doesn't reduce after establishing the horizontal portion 17 and the oblique portion 18. To prevent affect the normal operations of the corner fitting 1 such as hoist or fasten and so on, it need to increase appropriately the appearance size of the corner fitting 1 and to keep the hole position on normal operating of the corner fitting 1 without any changes. The increase of the overall external dimensions of the corner fitting 1 resultes in the increase of the partial volume of the inner cavity. This leads to accumulate some water easily therein. So a hole 20 is disposed in the outer side face 14 for eliminating the accumulated water in the inner cavity quickly.

When the present invention is assembled to a container, the door lintel 2 is welded to the inner side face 13 of the corner fitting 1. The outmost face of the door lintel 2 is in the same plane with the vertical face of the oblique portion 18. The corner pole 3 is welded to the bottom face 11 of the corner fitting 1. The outmost face of the inner corner pole 3 is in the same plane with the vertical face of the horizontal portion 17. Such all of the vertical face of the step of the corner fittings 1 and the outmost face of the door lintel 2 and the outmost face of the inner corner pole 3 are in the same plane, so the gate gaskets 4 can lean against said plane tightly to achieve a good sealing effect.

We claim:

1. A corner fitting for a container, comprising: a bottom face, a top face, an inner side face, an outer side face, a front end face and a rear end face, the front end face and the inner side face being cut out in part to form a step, the front end face being cut out to form a horizontal first portion of the step, and the bevel close to the front end face being cut out to form an oblique second portion of the step, the corner fitting having a bevel between the inner side face and the bottom face thereof.

2. The corner fitting according to claim 1, wherein the length of the first portion of the step is equal to or shorter than the length of the front end face, and the length of the second portion of the step is equal to or shorter than the length of the inner side face.

3. The corner fitting according to claim 2, wherein the first portion of the step and the second portion of the step connect together and transition smoothly.

4. The corner fitting as in any one of the preceding claims, wherein said corner fitting is an integrated structure.

5. The corner fitting according to claim 1, wherein said corner fitting comprises a hole on the outer side face for eliminating an accumulation of water in an inner cavity thereof.

* * * * *